US005497855A

United States Patent [19]

Moore

[11] Patent Number: 5,497,855

[45] Date of Patent: Mar. 12, 1996

[54] EXTERIOR FIRE FIGHTING AND EVACUATION SYSTEM FOR HIGH RISE BUILDINGS

[76] Inventor: Chester G. Moore, 949 Calabash Rd. NW., Calabash, N.C. 28467

[21] Appl. No.: 305,340

[22] Filed: Sep. 15, 1994

[51] Int. Cl.[6] ..... B66B 9/00

[52] U.S. Cl. ..... 187/239; 169/16; 182/51

[58] Field of Search ..... 187/239, 255, 187/406, 413, 414; 169/51, 70, 54, 62, 5, 10, 13, 16, 17, 18; 182/82, 141, 142, 51, 52

[56] References Cited

U.S. PATENT DOCUMENTS 4,406,351 9/1983 Littlejohn et al. ..... 182/51

4,865,155 9/1989 Montaigne et al. ..... 187/239

*Primary Examiner*—Kenneth Noland

*Attorney, Agent, or Firm*—John G. Mills and Associates

[57] ABSTRACT

This invention is an exterior fire fighting and evacuation system for high rise buildings. A pair of parallelly disposed vertical trollies are attached to the side of the building on opposite sides of a plurality of emergency exits. Decorative panels are provided on either side of the trollies that are aesthetically pleasing and serve to hide high pressure water and/or foam lines. A chain drive system within each of the pair of trollies mounts a support arm assembly on which a fire proof cab is removably mounted. This cab has front and rear doors and a remote control for operating a motor which drives the chains within both of the trollies simultaneously. This motor can also be operated manually if necessary.

9 Claims, 5 Drawing Sheets

EXTERIOR FIRE FIGHTING AND EVACUATION SYSTEM FOR HIGH RISE BUILDINGS

FIELD OF INVENTION

This invention relates to emergency equipment and more particularly to high rise building fire fighting and evacuation systems.

BACKGROUND OF INVENTION

Since multi-story buildings were first built, there has been a need for dependable access for fire fighters as well as for evacuation of the occupants thereof in case of fire and other emergencies.

Fixed exterior fire escapes have been commonly required on smaller buildings such as three or four stories and have even been installed on buildings as high as seven or eight stories. On taller buildings, almost universally fire proof stair wells have been required even though these commonly fill with smoke during a major fire.

In an effort to overcome to limitations of stair-type exterior fire escapes and fire proof stair wells on what is commonly referred to as high rise buildings which can go to a hundred or more floors or stories, exterior elevators have been developed and several of these have even been patented.

Several of these include exterior elevator shafts which are subject to becoming smoke filled as well as exterior elevators mounted on rails or the like, some of which can be fitted after the emergency arises.

These various exterior evacuation or fire escape systems are unsightly at best and are of limited utility.

CONCISE EXPLANATION OF REFERENCES

U.S. Pat. No. 4,469,198 to Robert Crump discloses an outside rescue elevator system for high rise buildings including an open portable elevator cab that can be stored remotely until needed. It is then connected to a vertical exterior track.

U.S. Pat. No. 4,569,418 to Augusta Novarini is considered of interest in that it discloses an insulated, portable booth that forms part of a fire escape system and includes a space filled with a cooling fluid which can be connected to a fire hose on a fire truck.

U.S. Pat. No. 3,517,774 to Roy E. Meyer is considered of interest in that it discloses an open tower elevator with the support means running within an exteriorly mounted tubular track.

U.S. Pat. No. 786,641 to Louis Grossmann is considered of interest in that it discloses an exterior fire escape that is mounted on a pair of tracks on the exterior of the building.

U.S. Pat. No. 2,122,908 to Charles D. Collins is considered of interest in that it discloses an exterior hoist with a de-mountable platform. The hoist runs in a pair of pipes that include longitudinal slots therein with a cable used as a lift means.

U.S. Pat. No. 4,664,226 to Michael Centanne is considered of interest in that it discloses an exterior escape system with a removable, power driven platform carriage.

U.S. Pat. No. 5,127,491 to Adrienne P. Just-Buddy is considered of interest in that discloses an exterior mounted fire/rescue elevator that is normally stored on the roof of a building.

Finally, U.S. Pat. No. 5,253,734 to Charles J. Laurutis and U.S. Pat. No. 4,350,224 to Fredrick Jochum et al are both considered of general interest in that they disclose additional exterior high rise emergency elevators while U.S. Pat. No. 3,831,711 to Luther H. Smith and U.S. Pat. No. 4,466,507 to Frank Itano disclose individual exteriorly mounted emergency escape means.

DESCRIPTION OF INVENTION

After much research and study into the above mentioned problems, the present invention has been developed to provide an exterior fire fighting and evacuation system for high rise buildings that is aesthetically pleasing when not in use and yet is a highly efficient, multi-purpose system during an emergency.

Decorative panels are provided with built-in water systems for covering exits and for connecting to fire and foam hoses.

The trolly that carries the enclosed cab has a longitudinal slot therein that is completely sealed when not in use and includes an alarm if tampered with.

The suspension system of the present invention is a chain driven system with a reversible motor. Emergency brakes are provided in the form of foot petals for engaging the edges of the trolly. The reversible motor can be operated either remotely from the cab or from the ground. Breathing air is included in the upper portion of the cab and deployable air masks are operatively connected thereto in case the cab becomes filled with smoke or toxic fumes.

The vertical trollies that form part of the present invention are vertical tubes with longitudinal slots therein with decorative panels on either side thereof which are used for both aesthetics and have utility purposes.

In view of the above it is an object of the present invention to provide a highly efficient, aesthetically pleasing and yet relatively simple exterior fire fighting and evacuation system for high rise buildings.

Another object of the present invention is to provide an exterior system for high rise buildings including water lines for providing sprinkler systems at building exits as well as connection points for fire and foam hoses. Another object of the present invention is to provide a closure for a longitudinal slot in a trolly support system that includes an alarm if the closure is tampered with.

Another object of the present invention is to provide an emergency braking system for a high rise exterior fire fighting and evacuation system.

Another object of the present invention is to provide a foot pedal actuating braking system for exteriorly mounted cabs on high rise buildings.

Another object of the present invention is to provide a cab mounted on the exterior of a high rise building that remains operable during high winds and in fire ball explosion situations.

Another object of the present invention is to provide a chain driven fire fighting and evacuation system mounted on the exterior of high rise buildings.

Another object of the present invention is to provide an air supply in the cab of an exterior evacuation system for high rise buildings that include deployable air masks that can be used for breathing in smokey and toxic fume conditions.

Other objects and advantages of the present invention will become apparent and obvious from a study of the following description and the accompanying drawings which are merely illustrative of such invention.

DETAILED DESCRIPTION OF INVENTION

Figure 1:
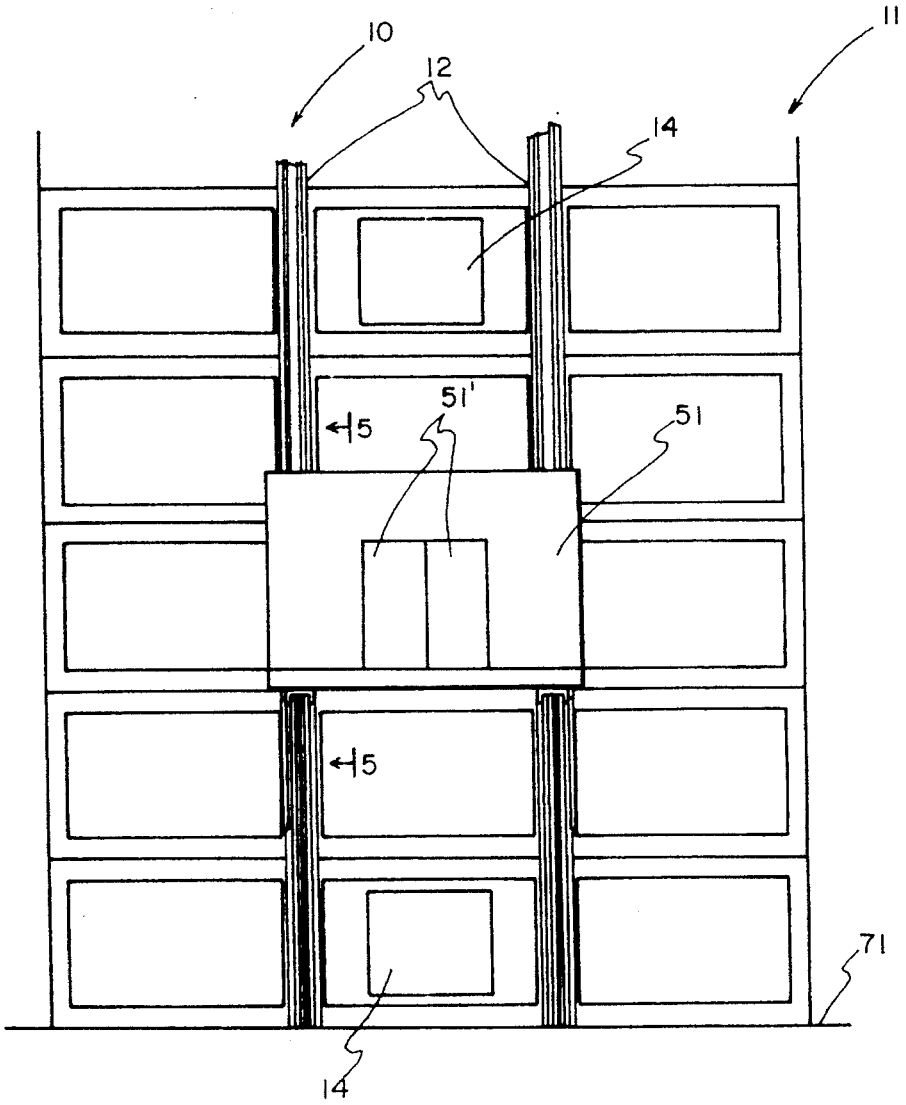
FIG. 1 is a front elevational view of a high-rise building with the exterior fire fighting and evacuation system of the present invention installed thereon.

The exterior fire fighting and evacuation system of the present invention, indicated generally at 10, is mounted on and used in conjunction with high-rise buildings such as that indicated generally at 11.

A pair of tubular trollies 12 are permanently mounted by suitable means such as bolts 13 to the exterior of building 11 on opposite sides of suitable exit doors or windows 14.

Each of the trollies 12 has a vertical slot 15 in the side opposite where such trollies are connected to building 11. These slots are normally covered by a material 16 which can be easily ruptured when the fire fighting and evacuation system is put in operation. Heavy duty aluminum foil or similar material is suitable for this purpose. Also the material 16 assures that the interior of the trollies remain clear of debris and other foreign matter that might effect the functioning of the emergency system. To assure that the material 16 has not been ruptured or tampered with, a wire 17 is mounted on the interior of such material. When this wire is broken, a signal will be sent to an alarm system so that the material can be repaired in an expeditious manner. Alarm systems of this type are well known to those skilled in the art and further detail discussion of the same is not deemed necessary.

Figure 2:
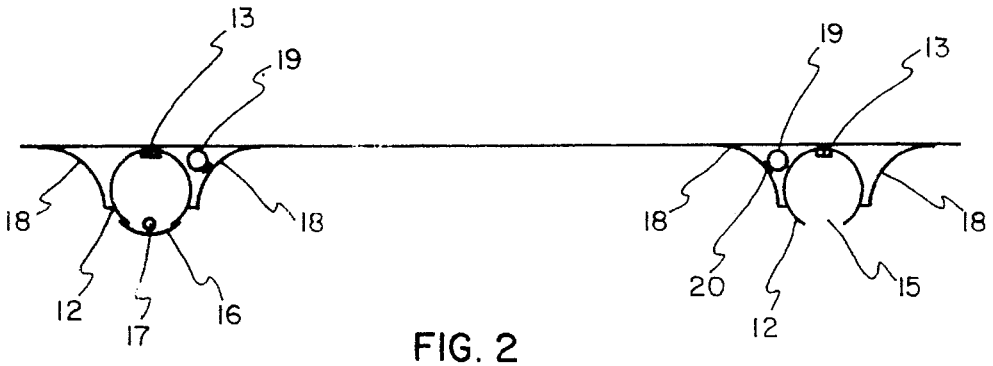
FIG. 2 is a typical sectional view of the trollies portion of the present invention mounted on the side of the building.

Decorative panels 18 are mounted on opposite sides of each of the longitudinal slots 15 in each of the trollies 12. These panels extend back to and are mounted on the exterior of building 11 as can clearly be seen in FIGS. 1 and 2.

Vertical water and/or foam lines 19 are mounted behind at least one of the panels 18 of each pair of the trollies 12. A quick connect valve 20 is provided at each of exit doors or windows 14 so that when the exterior fire fighting and evacuation system is operating, the fireman or other persons using the system can have easy access to water and/or fire extinguishing foam.

Figure 3:
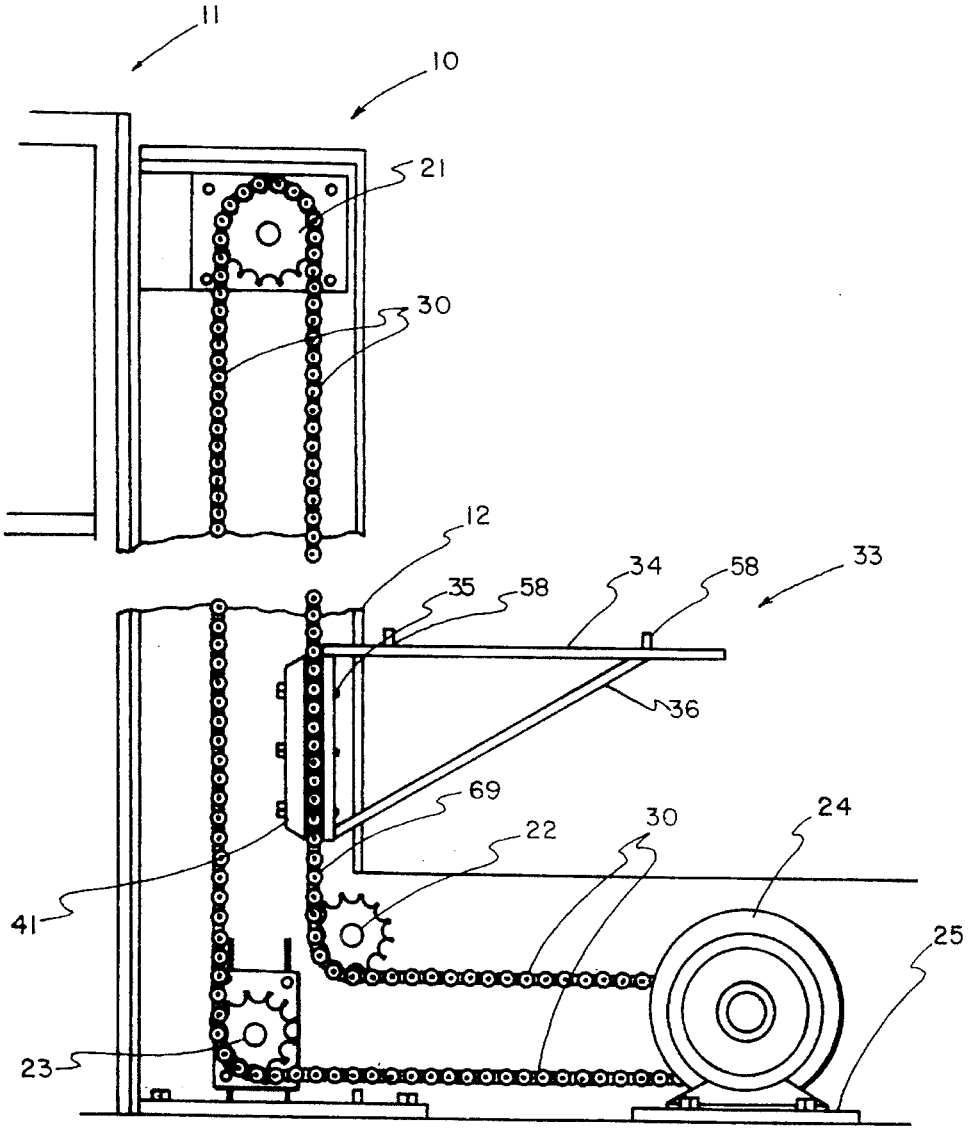
FIG. 3 is a somewhat schematic side elevational view of the chain drive system of the present invention.

A sprocket 21 is rotatively mounted in the upper portion of each of the trollies 12. Sprocket 22 is rotatively mounted in the lower portion of each of the trollies 12. A third or idler sprocket 23 is provided below and at an angle to lower sprocket 22. This idler sprocket is preferably mounted so that it can move up and down to set the tension on the drive chain 24 trained over such sprockets as can clearly be seen in FIG. 3.

Figure 4:
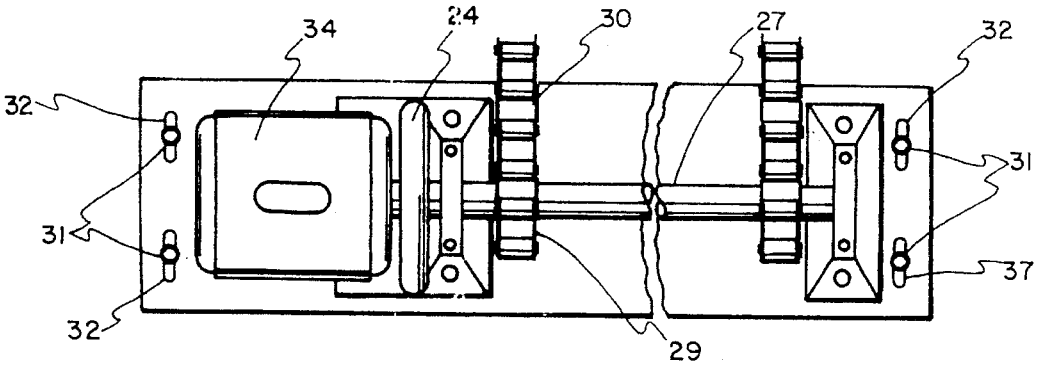
FIG. 4 is a top plan view of the drive motor and drive shaft of the present invention.

A reversible drive motor 24 is mounted on a motor stand 25 and has a standard reduction gear 26. A drive shaft 27 is operatively connected to reduction gear 26 and is supported on its ends by bearings 28. Adjacent each of these bearings is a drive sprocket 29 that is fixedly mounted on drive shaft 27 as can clearly be seen in FIG. 4. Each of the drive sprockets 29 are in operative alignment with the pair of vertical trollies 12 and their respective upper sprocket 21, lower sprocket 22 and idler sprocket 23.

When drive chain 24 is trained over one of the drive sprockets 29 and aligned lower sprocket 22, upper sprocket 21 and idler sprocket 23, reversible drive motor 24 can move said drive chain up and down within the respective trolly 12.

The stand 25 that mounts the drive motor 21, reduction gear 26, and shaft bearings 28 is held in place by bolts 31 that pass through slotted openings 32 in said stand. Thus it can be seen that by loosening the bolts 31, the motor stand can be moved toward or away from the trollies to also tension the drive chain 30 if desired.

A support arm assembly, indicated generally at 33, is provided for each of the trollies 12. This assembly includes a horizontally disposed, outwardly projecting arm portion 34 connected to a vertically disposed interior slide portion 35 with a brace portion 36 connecting the outer end of arm portion 34 to the lower portion of slide 36.

Figure 9:
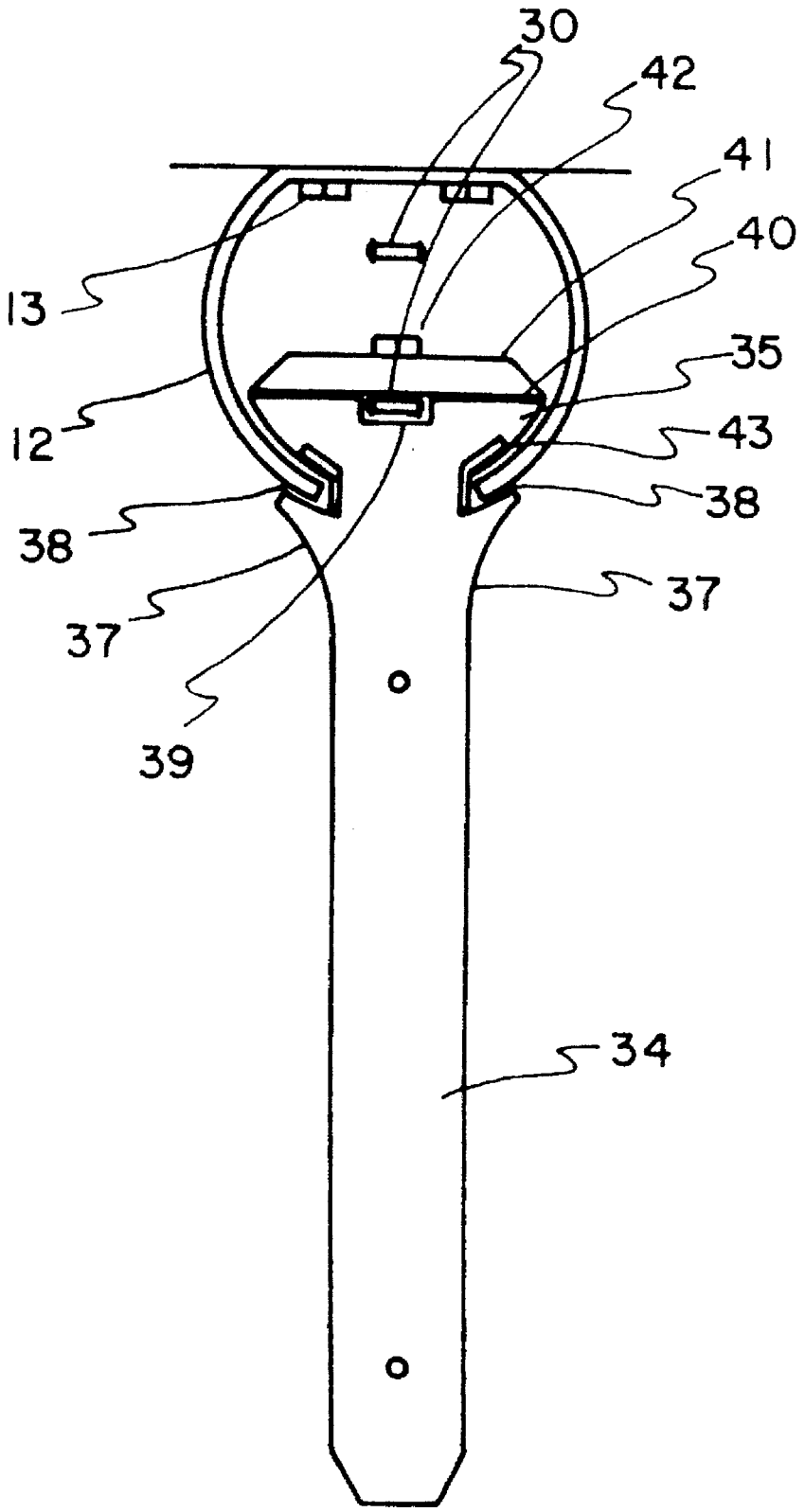
FIG. 9 is a sectional view similar to the view above in FIG. 8 with the brake means removed and showing the entire support arm.

Vertically disposed, outwardly projecting flanges 37 form vertical slots 38 in assembly 33 as can clearly be seen in FIG. 9.

A vertical slot is also provided on the interior surface of slide portion 35 into which the drive chain 30 can be placed. A backing plate 41 is then placed juxtaposed to the interior surface 40 of the interior slide portion 35. Removable securing bolts 42 pass through openings 30' in drive chain 30 and into slide portion 35 as can clearly be seen in FIGS. 3, 7 and 9.

Figure 7:
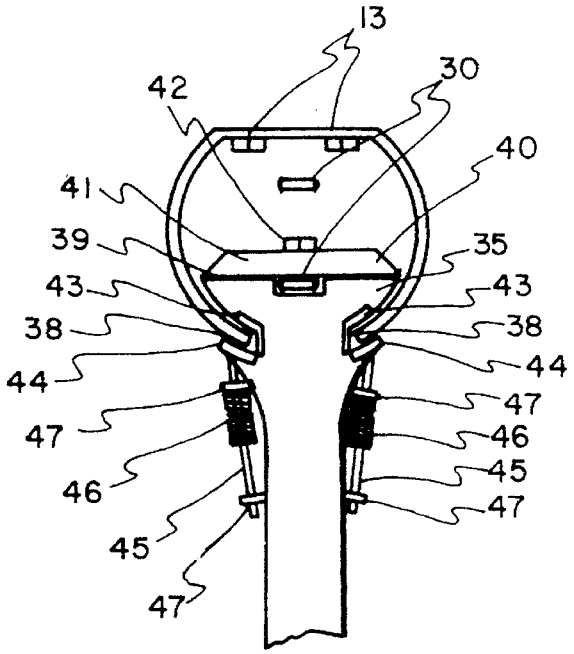
FIG. 7 is a sectional view taken through lines 7—7 of FIG. 5.
Figure 8:
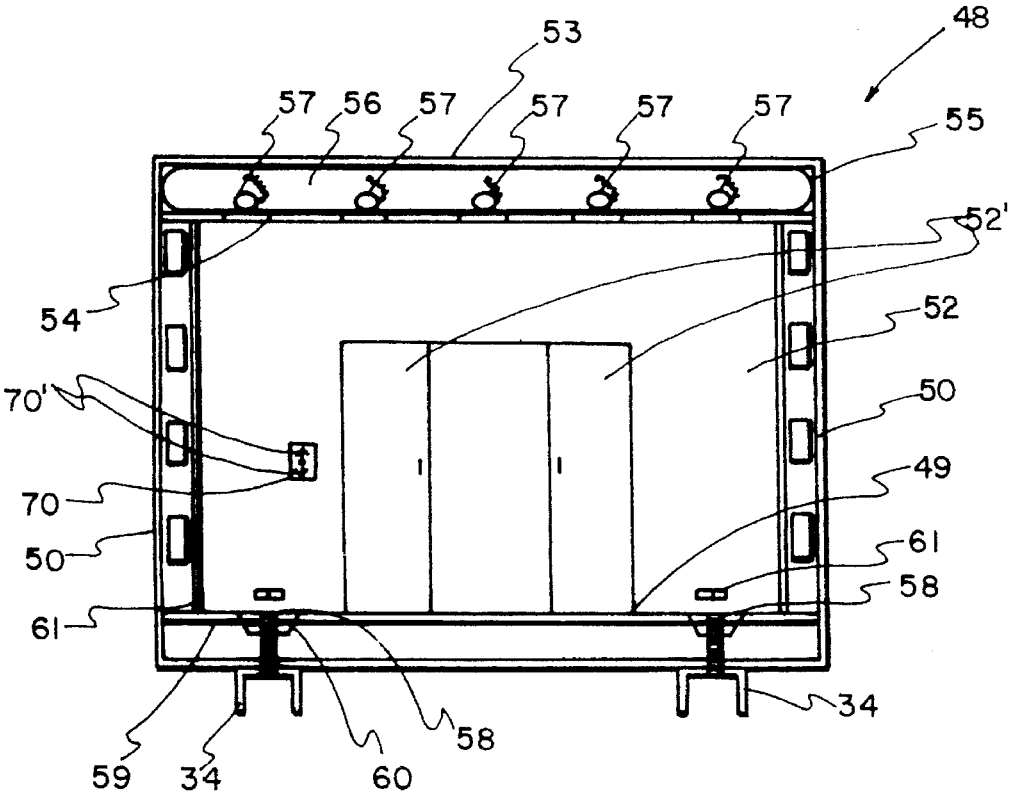
FIG. 8 is a sectional view taken through lines 8—8 of FIG. 5.

A fixed brake pad 43 is provided on the curved portion of each of the slide portions 35 adjacent to and interiorly of slide slots 38 as can clearly be seen in FIGS. 7 and 9.

A pair of operational brake pads 44 are mounted on one end of a pair of push rods 45. Each of these push rods are mounted on a pair of mounting brackets 47 as clearly shown in FIG. 7. Springs 46 bias each of these push rods 45 and their associated brake pads 44 away from the associated slot openings 38. The operation of the braking system will hereinafter be described in greater detail.

The cab portion of the present invention, indicated generally at 48, includes a floor structure 49, end walls 50, front wall 51, rear wall 52 and top 53. The front and rear walls 51 and 52 include sliding doors 51' and 52', respectively.

The space between the top 53 and ceiling 54 forms a ceiling pocket 55 in which is operatively mounted a compressed air tank 56 operatively connected to a plurality of air masks 57. These masks are designed to automatically deploy when either the oxygen level within the cab becomes low or smoke and fume levels become high in the same manner that oxygen masks deploy from the ceiling of aircraft cabins upon sudden depressurization occurs. Since devices of this type are well known to those skilled in the art, further detailed discussion of the same is not deemed necessary.

A pair of threaded, upwardly projecting mounting pins 58 are provided on each of the arms 34 and are adapted to pass through openings 59 in the floor structure 49. Adjacent each of the openings 59 is a recess 60 into which the mounting nuts 61 enter when threaded onto the ends of threaded mounting pins 58.

Figure 5:
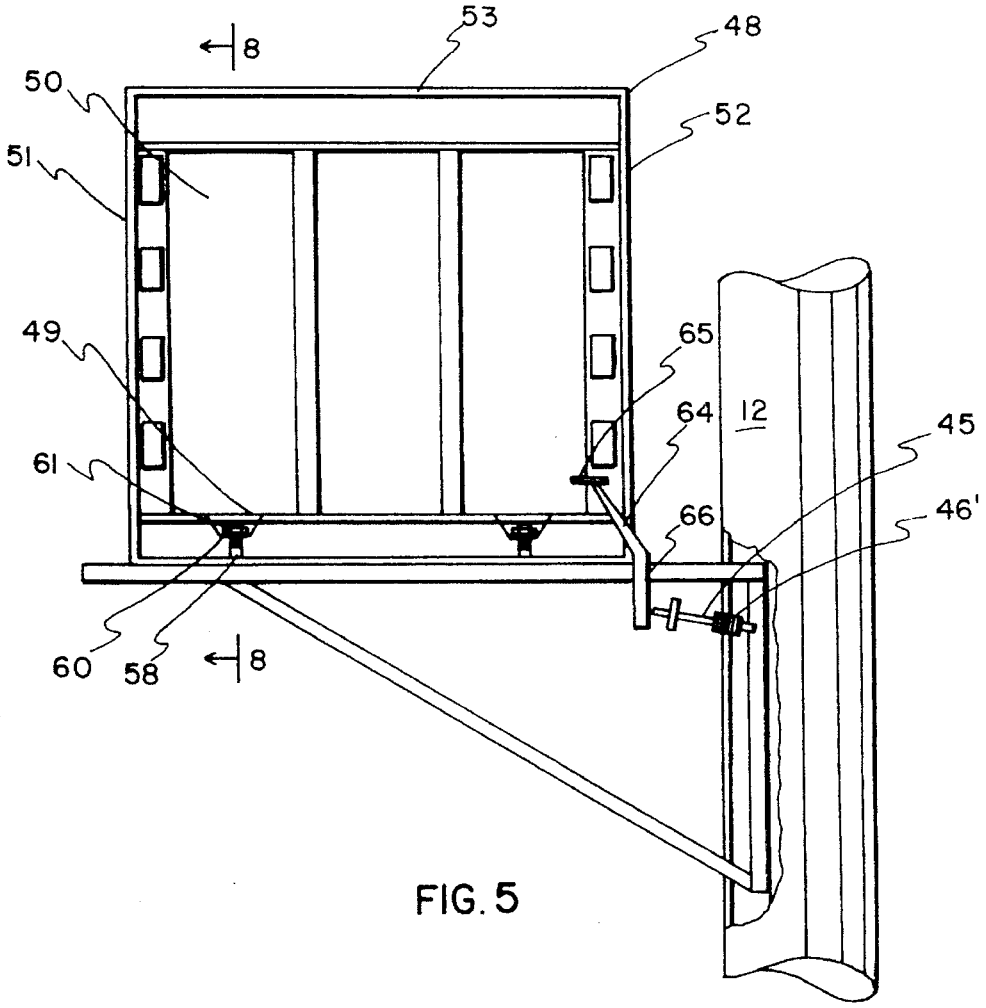
FIG. 5 is a sectional view taken through lines 5—5 of FIG. 1.
Figure 6:
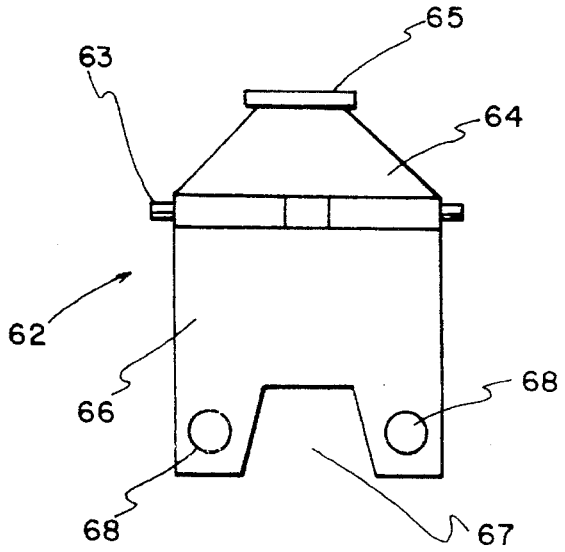
FIG. 6 is an elevational view of the brake actuating plate.

A brake actuating plate 62 is pivotively mounted as indicated at 63 to the exterior of cab 48. The upper portion of this plate projects into the interior of cab 48 and has a brake pedal 65 mounted on the end thereof as clearly shown in FIG. 5.

The lower portion 66 of brake actuating plate 62 includes a cutout 67 that allows the plate to straddle the arm portion 34 of the support assembly 33.

A pair of recesses 68 are provided on the lower portion 66 of plate 62 and are so spaced to pushingly engage the ends of the push rods 45 opposite their respective brake pads 44.

Since the braking system of the present invention is for emergency use only, a brake assembly is provided adjacent each of the support assemblies 33 on opposite sides of the sliding doors 52' in rear wall 52 so that ready access to either of the brakes is provided to the occupants of the cab.

To use the exterior fire fighting and evacuation systems of the present invention, a support arm assembly 33 is operatively mounted on each of the pair of trollies 12 by moving the slide portion 35 into the interior of the trolly through opening 69 in the lower portion of each of said trollies. The respective drive chain 30 is then placed in slot 39 of slide portion 35 and the backing plate 41 moved in place. Securing bolts 42 are then passed through the drive chain 30 to hold the slide portion 39, the backing plate 41, and the drive chain in place.

The arm assembly 33 can either be left mounted on the trolly for instant mounting of the cab portion 48 thereon, or said assemblies can be mounted on the drive chains 30 only when needed. In either case, when the need arises for use of the exterior fire fighting and evacuation system of the present invention, the cab portion 48 can be brought from the fire station, rescue station or other storage area to the building 11 and quickly mounted on the arm portions 34 by placing such cabs on the mounting pins 48 and securing the same in place by tightening down on the mounting nuts 61.

The drive chains 30 and their associated sprockets, drive shaft and motor are at all times maintained in a proper tension and operative condition. Once the cab portion 48 of the present invention has been mounted on its respective arm assemblies 33, the same is ready to be used.

A remote motor control 70 can be mounted in the cab 48 with up, down, and stop push-buttons 70' being included. This remote control can be either operatively wired from the interior of the cab to the motor or can be a wireless remote control. Since controls of this type are well known to those skilled in the art, further detailed discussion the same is deemed not necessary.

Drive motor 24 can also be operated manually with two way radios being used by the occupants of the cab. Again, manual operation of motors and two way radios are well known to those skilled in the art for the detailed discussion the same is deemed not necessary.

Once the cab 48 has been operatively mounted on the arm assemblies 33, such cab is ready to be operated for emergency fire fighting and evacuation of the building 11. As the cab 48 moves upwardly along the trollies 12, the material 16 covering the vertical slots 15 in such trollies will simply be ruptured but will not impede the vertical operation of the cab supported by the arm assemblies 33.

As the cab 48 moves upwardly on the exterior of building 11, it passes designated exit doors or windows. Whenever it is deemed appropriate to evacuate personnel from a particular exit 14 or to fight a fire at that location, the cab 48 is moved to a point that the rear doors 52' are in vertical alignment with said exit. The doors can then be opened. If the need for water to cool down and/or fire fight, it is immediately available from one of the lines 19 and the associated quick connect valve 20. Should fire exist in areas separate from but adjacent the exit, a curtain or spray of water can be provided to allow escape thru the exit into the cab 48 of the fire fighting and evacuation system 10 of the present invention. Also one of the lines 19 can be filled with fire fighting foam which will allow firemen to exit the cab 48 and enter the building 11 through the adjacent exit 14 to suppress the fire with such foam.

There are, of course, an infinite additional number of scenarios relative to how and when the system of the present invention is used.

Because of the construction and structure of the present invention, the cab and its associated trollies, etc. can withstand high winds and fire ball explosion situations and still operate to carry to out its intended purposes.

The power to operate the drive motor local portion 24 of the present invention can be from either the standard power grid or it can be operated from an emergency generator.

Because of the relative length of the interior slide portion 35 of the support arm assembly 33 to the length of the arm portions 34, an additional safety feature is created wherein a free falling cab 48 will have a ladder affect, dropping only a short distance before binding and stopping, and then falling another short distance thus effectively walking itself down the trollies until such cab reaches the ground 71.

Should the oxygen within the cab 18 be depleted to a predetermined level, or if a predetermined level of smoke or fumes is reached, air mask doors 72 will automatically open and air masks 57 deploy and hang down similar to the deployment of oxygen masks from the overhead in commercial airliners. Once the user pulls the mask down and places it over his or her face, air will flow from tank 56 so that such person can breath until such person or persons can exit the cab either at a safe location in the building or the cab returns to ground level.

Chains are used rather than cables or similar means to operate the fire fighting and evacuation system of the present invention since chains will not slip or stretch and are not affected by water or ice.

The cab 48 of the present invention is preferably made from fire proof material, is well insulated, and the front and rear doors 51' and 52' are air tight when closed.

When the need for the system of the present invention has passed, the four mounting nuts 61 are simply removed from the threaded mounting pins 58 and the relatively light weight cab 48 lifted from the arm assemblies 33. New rupturable material 16 is then placed over the longitudinal slots 15 in the trollies 12 to seal the interior thereof and prevent contamination that might affect the later operation of the system from entering into such trollies. The arms 33 can either be left mounted on the trollies at a storage level, such as an under ground location at the base of the trollies, or the arm assemblies 33 can be removed and stored in the cab 48 at a remote location until the same is again needed.

With numerous buildings similarly equipped with the trollies, operating mechanisms and assemblies of the present invention, only a few cabs 48 would be required to be stored and ready for emergency use.

From the above it can be seen that the present invention provides a highly efficient exterior fire fighting and evacuation system for high rise buildings. Because of the simplicity of the present invention, it is relatively fool proof, highly efficient in use, and can be there for multiple purposes during an emergency.

The present invention can of course be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An exterior fire fighting and evacuation system for high rise buildings having a plurality of vertically aligned exits that can be used in an emergency comprising: a pair of tube like vertical trollies attached to said building on opposite sides of said vertically aligned exits, each of said vertical trollies having a longitudinal slot-like opening in one side thereof; an arm assembly means slidably mounted on each of said trollies and outwardly projecting through said longitudinal slot-like opening; a cab means extending between and removably mounted on said arm assembly means; chain drive means operatively connected to a reversible motor operatively connected to each of said arm assemblies within each of said trollies; and built in high pressure lines adjacent at least one of said trollies for making fire retardant fluids available to the occupants of said cab at various locations on said building whereby said cab can be mounted on said arm assemblies when an emergency arises and said motor can drive said chain drives to lift and lower the arm assemblies and their associated cab up and down the exterior of said building and fire retardant fluids are available on the face of said building for fire fighting and to aid in evacuation of such building.

2. The system of claim 1 wherein decorative panels extend between a portion of said trollies and said building.

3. The system of claim 2 wherein said high pressure fluid lines are concealed by at least one of said decorative panels.

4. The system of claim 1 wherein a rupturable material covers the longitudinal slot-like opening in each of the trollies when the same is not in use whereby the interior of said trollies are protected from contamination.

5. The system of claim 4 wherein a means for sensing a rupture in said rupturable material is operatively connected to an alarm system whereby the integrity of said rupturable material over said longitudinal slot-like openings in said trollies can be maintained.

6. The system of claim 1 wherein an emergency braking system is provided for said cab means.

7. The system of claim 6 wherein a brake pedal inside said cab actuates a brake means on said trolly.

8. The system of claim 1 wherein said cab can be operated either manually or remotely.

9. The system of claim 8 wherein said remote control for said cab is wireless.

* * * * *